US009029057B2

(12) United States Patent
Kmiecik-Lawrynowicz et al.

(10) Patent No.: US 9,029,057 B2
(45) Date of Patent: May 12, 2015

(54) SINGLE COMPONENT DEVELOPER COMPOSITION

(71) Applicant: Xerox Corporation, Norwalk, CT (US)

(72) Inventors: Grazyna E. Kmiecik-Lawrynowicz, Fairport, NY (US); Maura A. Sweeney, Irondequoit, NY (US); Samir Kumar, Pittsford, NY (US); Daniel W. Asarese, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 128 days.

(21) Appl. No.: 13/864,270

(22) Filed: Apr. 17, 2013

(65) Prior Publication Data

US 2014/0315127 A1 Oct. 23, 2014

(51) Int. Cl.

| | |
|---|---|
| ***G03G 9/093*** | (2006.01) |
| ***G03G 9/087*** | (2006.01) |
| ***G03G 9/097*** | (2006.01) |

(52) U.S. Cl.

CPC ..... *G03G 9/09321* (2013.01); *G03G 9/09364* (2013.01); *G03G 9/09378* (2013.01); *G03G 9/09716* (2013.01); *G03G 9/09725* (2013.01)

(58) Field of Classification Search

CPC ..... G03G 9/09716; G03G 9/09725; G03G 9/09364; G03G 9/09321

USPC ..... 430/108.7, 108.3, 110.2, 109.3

See application file for complete search history.

(56) References Cited

U.S. PATENT DOCUMENTS

| | | | | |
|---|---|---|---|---|
| 8,790,856 | B2 * | 7/2014 | Yang et al. | 430/108.7 |
| 2010/0244286 | A1 * | 9/2010 | Lagsa | 257/789 |
| 2012/0129089 | A1 * | 5/2012 | Kmiecik-Lawrynowicz et al. | 430/108.3 |

OTHER PUBLICATIONS

American Chemical Society (ACS) File Registry Number No. 3069-40-7 on STN, copyright 2014, which was entered in STN on Nov. 16, 1984.*

American Chemical Society (ACS) File Registry Number No. 999-97-3 on STN, copyright 2014, which was entered in STN on Nov. 16, 1984.*

* cited by examiner

*Primary Examiner* — Janis L Dote

(74) *Attorney, Agent, or Firm* — MDIP LLC

(57) ABSTRACT

Emulsion aggregation toner comprising: a resin; a wax; a colorant; an encapsulating shell; and a silica external additive comprising: first silica particles comprising fumed silica particles surface treated with octyldimethylsiloxane and having average particle diameter about 6-20 nm, present in amount of about 0.1-1% by weight of the toner; second silica particles comprising colloidal silica particles surface treated with hexamethyldisiloxane and having average particle diameter about 80-200 nm, present in amount of about 1-2% by weight of the toner; third silica particles comprising fumed silica particles surface treated with polydimethylsiloxane and having average particle diameter about 25-65 nm, present in amount of from about 0.5-1.5% by weight of the toner; and fourth silica particles comprising fumed silica particles surface treated with hexamethyldisiloxane and having average particle diameter about 25-65 nm, present in amount of about 1-2.5% by weight of the toner.

20 Claims, 1 Drawing Sheet

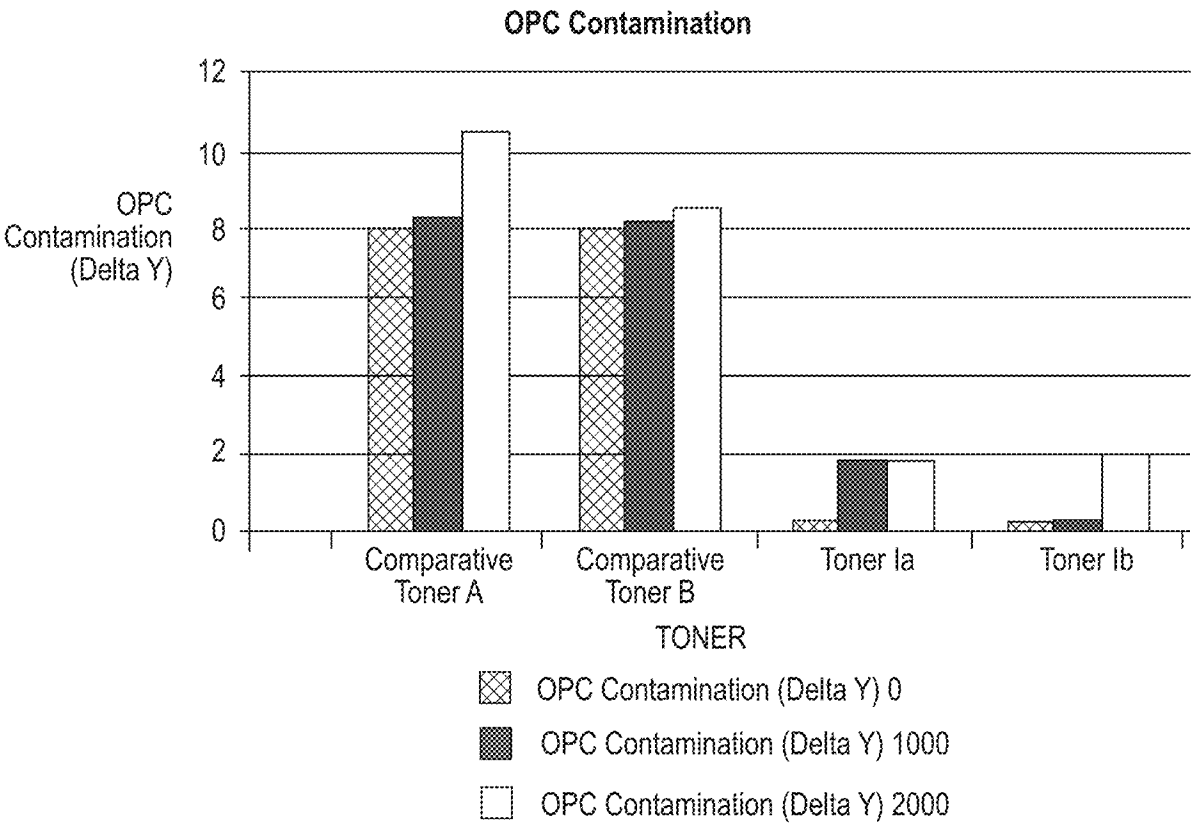
OPC Contamination
OPC Contamination (Delta Y)
12
10
8
6
4
2
0
Comparative Toner A
Comparative Toner B
Toner Ia
Toner Ib
TONER
OPC Contamination (Delta Y) 0
OPC Contamination (Delta Y) 1000
OPC Contamination (Delta Y) 2000

SINGLE COMPONENT DEVELOPER COMPOSITION

BACKGROUND

Disclosed herein is a toner composition suitable for use in single component development processes.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. Nos. 5,916,725 and 7,785,763 and U.S. Patent Publication 2008/0107989, the disclosures of each of which are totally incorporated herein by reference.

In some single component developers (i.e., developers in which a toner is used without a carrier), the toner can exhibit disadvantages such as deposition of wax or silica onto the developer roll over time, leading to functional defects in the hardware and eventual print defects. Other difficulties commonly encountered with developers containing relatively large size external additive particles include poor toner flow characteristics, image deletions, and image fading. Accordingly, while known materials are suitable for their intended purposes, a need remains for toners suitable for use in single component development systems that exhibit low melt. In addition, a need remains for toners suitable for use in single component development systems that exhibit desirable fusing characteristics. Further, a need remains for toners suitable for use in single component development systems that exhibit reduced buildup on the developer roll of materials such as pigment, silica, and wax. Additionally, a need remains for toners suitable for use in single component development systems that exhibit desirable or improved charging stability. There is also a need for toners suitable for use in single component development systems that exhibit reduced fuser contamination. In addition, there is a need for toners suitable for use in single component development systems that exhibit desirable flow characteristics. Further, there is a need for toners suitable for use in single component development systems that produce uniform images. Additionally, there is a need for toners suitable for use in single component development systems that produce high yield of toner from the toner cartridge. A need also remains for toners suitable for use in single component development systems that exhibit improved image quality while also enabling improved printing speed.

SUMMARY

Disclosed herein is a single component developer comprising an emulsion aggregation toner which comprises: (a) a resin; (b) a wax; (c) a colorant; (d) an encapsulating shell; and (e) a silica external additive, said silica external additive comprising: (i) first silica particles, said first silica particles comprising fumed silica particles surface treated with octyldimethylsiloxane and having an average particle diameter of from about 6 to about 20 nm, present in an amount of from about 0.1% to about 1% by weight of the toner; (ii) second silica particles, said second silica particles comprising colloidal silica particles surface treated with hexamethyldisiloxane and having an average particle diameter of from about 80 to about 200 nm, present in an amount of from about 1% to about 2% by weight of the toner; (iii) third silica particles, said third silica particles comprising fumed silica particles surface treated with polydimethylsiloxane and having an average particle diameter of from about 25 to about 65 nm, present in an amount of from about 0.5% to about 1.5% by weight of the toner; and (iv) fourth silica particles, said fourth silica particles comprising fumed silica particles surface treated with hexamethyldisiloxane and having an average particle diameter of from about 25 to about 65 nm, present in an amount of from about 1% to about 2.5% by weight of the toner; said developer being substantially free of carrier particles. Also disclosed is a single component developer comprising an emulsion aggregation toner which comprises: (a) a styrene/butylacrylate copolymer resin; (b) a wax having a melting point of no more than about 100° C.; (c) a colorant; (d) an encapsulating shell; and (e) a silica external additive, said silica external additive comprising: (i) first silica particles, said first silica particles comprising fumed silica particles surface treated with octyldimethylsiloxane and having an average particle diameter of from about 8 to about 16 nm, present in an amount of from about 0.2% to about 0.9% by weight of the toner; (ii) second silica particles, said second silica particles comprising colloidal silica particles surface treated with hexamethyldisiloxane and having an average particle diameter of from about 90 to about 180 nm, present in an amount of from about 1.1% to about 1.75% by weight of the toner; (iii) third silica particles, said third silica particles comprising fumed silica particles surface treated with polydimethylsiloxane and having an average particle diameter of from about 30 to about 60 nm, present in an amount of from about 0.6% to about 1.2% by weight of the toner; and (iv) fourth silica particles, said fourth silica particles comprising fumed silica particles surface treated with hexamethyldisiloxane and having an average particle diameter of from about 30 to about 60 nm, present in an amount of from about 1.25% to about 2% by weight of the toner; said developer being substantially free of carrier particles. Further disclosed is a single component developer comprising an emulsion aggregation toner which comprises: (a) a styrene/butylacrylate copolymer resin having a Mw value of from about 30,000 to about 40,000 and a Mn value of from about 8,000 to about 15,000; (b) a paraffin wax having a melting point of no more than about 100° C. and present in the toner in amount of from about 1% to about 25% by weight; (c) a pigment colorant; (d)

an encapsulating shell; and (e) a silica external additive, said silica external additive comprising: (i) first silica particles, said first silica particles comprising fumed silica particles surface treated with octyldimethylsiloxane and having an average particle diameter of from about 10 to about 14 nm, present in an amount of from about 0.3% to about 0.8% by weight of the toner; (ii) second silica particles, said second silica particles comprising colloidal silica particles surface treated with hexamethyldisiloxane and having an average particle diameter of from about 100 to about 150 nm, present in an amount of from about 1.25% to about 1.45% by weight of the toner; (iii) third silica particles, said third silica particles comprising fumed silica particles surface treated with polydimethylsiloxane and having an average particle diameter of from about 35 to about 55 nm, present in an amount of from about 0.7% to about 0.9% by weight of the toner; and (iv) fourth silica particles, said fourth silica particles comprising fumed silica particles surface treated with hexamethyldisiloxane and having an average particle diameter of from about 35 to about 55 nm, present in an amount of from about 1.5% to about 1.8% by weight of the toner; said developer being substantially free of carrier particles.

BRIEF DESCRIPTION OF THE DRAWING

The FIGURE shows the results of organic photoreceptor (OPC) contamination testing for toners prepared as disclosed herein and comparative toners.

DETAILED DESCRIPTION

Disclosed herein are toners suitable for use in single component development processes.

The toners are emulsion aggregation toners that can be prepared from any desired or suitable resins suitable for use in forming a toner. Such resins, in turn, can be made of any suitable monomer or monomers. Suitable monomers useful in forming the resin include styrenes, acrylates, methacrylates, butadienes, isoprenes, acrylic acids, methacrylic acids, acrylonitriles, mixtures thereof, and the like.

Examples of suitable resins include polyolefins, polyethylene, polybutylene, polyisobutyrate, ethylene-propylene copolymers, ethylene-vinyl acetate copolymers, polypropylene, and the like, as well as mixtures thereof. Specific examples of resins which can be used include poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like, as well as mixtures thereof.

Examples of other suitable latex resins or polymers which can be used include poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butylacrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene); poly(styrene-propyl acrylate), poly(styrene-butylacrylate), poly(styrene-butadiene-acrylic acid), poly(styrene-butadiene-methacrylic acid), poly(styrene-butadiene-acrylonitrile-acrylic acid), poly(styrene-butylacrylate-acrylic acid), poly(styrene-butylacrylate-methacrylic acid), poly(styrene-butylacrylate-acrylonitrile), poly(styrene-butylacrylate-acrylonitrile-acrylic acid), poly (styrene-butylacrylate-beta carboxy ethyl acrylate), and the like, as well as mixtures thereof. The polymers can be block, random, or alternating copolymers, as well as combinations thereof. In a specific embodiment, the polymer is a styrene/n-butylacrylate/β-carboxyethylacrylate copolymer wherein the ratio of monomers is from about 69 to about 90 parts by weight styrene, from about 9 to about 30 parts by weight n-butylacrylate, and from about 1 to about 10 parts by weight β-carboxyethylacrylate, wherein the Mw value is from about 30,000 to about 40,000, and wherein the Mn value is from about 8,000 to about 15,000.

In specific embodiments, the resin can have a weight average molecular weight (Mw) of in one embodiment at least about 15,000, in another embodiment at least about 20,000, and in yet another embodiment at least about 25,000, and in one embodiment no more than about 50,000, in another embodiment no more than about 40,000, and in yet another embodiment no more than about 35,000.

In specific embodiments, the resin can have a number average molecular weight (Mn) of in one embodiment at least about 4,000, in another embodiment at least about 6,000, and in yet another embodiment at least about 8,000, and in one embodiment no more than about 20,000, in another embodiment no more than about 15,000, and in yet another embodiment no more than about 10,000.

Preparation of Resin

The emulsion polymer (to prepare emulsion aggregation particles) can be prepared by any desired or effective method. While the latex polymer can be prepared by any method within the purview of those skilled in the art, the latex polymer can, for example, be prepared by emulsion polymerization methods, such as semi-continuous emulsion polymerization. The latex can then be used to prepare a toner by, for example, emulsion aggregation methods. Emulsion aggregation entails aggregation of the latex polymer into larger size particles. Toners can be prepared by emulsion aggregation where a colorant is included with the latex polymer to be subjected to aggregation.

Any monomer suitable for preparing a latex for use in a toner can be used. As noted above, the toner can be produced by, for example, emulsion aggregation (EA). Suitable monomers useful in forming a latex polymer emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like. The latex polymer can include a single polymer or can be a mixture of polymers. Polymers include, for example, styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly (styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butylacrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene), poly(styrene-propyl acrylate), poly(styrene-butylacrylate), poly(styrene-butadiene-acrylic acid), poly(styrene-butadiene-methacrylic acid), poly(styrene-butadiene-acrylonitrile-acrylic acid), poly(styrene-butylacrylate-acrylic acid), poly(styrene-butylacrylate-methacrylic acid), poly(styrene-butylacrylate-acrylononitrile), poly(styrene-butylacrylate-acrylonitrile-acrylic acid), poly(styrene-butadiene), poly(styrene-isoprene), poly(styrene-butyl methacrylate), poly(styrene-butylacrylate-acrylic acid), poly(styrene-butyl methacrylate-acrylic acid), poly (butyl methacrylate-butylacrylate), poly(butyl methacrylate-acrylic acid), poly(acrylonitrile-butylacrylate-acrylic acid), and combinations thereof. The polymers can be block, random, or alternating copolymers.

Toner Particle

Toner particle compositions can be prepared by emulsion-aggregation processes that include aggregating a mixture of a latex, an optional colorant, an optional wax, any other desired or required additives, and emulsions including the selected resins described above, optionally in surfactants, and then coalescing the aggregate mixture at the temperature above the Tg of the aggregate resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ available from Daiichi Kogyo Seiyaku, combinations thereof, and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants, which are usually positively charged, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, as well as mixtures thereof.

Wax

Optionally, a wax can also be combined with the resin and other toner components in forming toner particles. When included, the wax can be present in any desired or effective amount, in one embodiment at least about 1% by weight, and in another embodiment at least about 5% by weight, and in one embodiment no more than about 25% by weight, and in another embodiment no more than about 20% by weight. Examples of suitable waxes include those having, for example, a weight average molecular weight of in one embodiment at least about 500, and in another embodiment at least about 1,000, and in one embodiment no more than about 20,000, and in another embodiment no more than about 10,000. Examples of suitable waxes include polyolefins, such as polyethylene, polypropylene, and polybutene waxes, including those commercially available from Allied Chemical and Petrolite Corporation, for example POLYWAX™ polyethylene waxes from Baker Petrolite, wax emulsions available from Michaelman, Inc. and Daniels Products Company, EPOLENE N-15™ commercially available from Eastman Chemical Products, Inc., and VISCOL 550-P™, a low weight average molecular weight polypropylene available from Sanyo Kasei K. K., and the like; plant-based waxes, such as carnauba wax, rice wax, candelilla wax, sumacs wax, jojoba oil, and the like; animal-based waxes, such as beeswax and the like; mineral-based waxes and petroleum-based waxes, such as montan wax, ozokerite, ceresin, paraffin wax, microcrystalline wax, Fischer-Tropsch wax, and the like; ester waxes obtained from higher fatty acids and higher alcohols, such as stearyl stearate, behenyl behenate, and the like; ester waxes obtained from higher fatty acid and monovalent or multivalent lower alcohols, such as butyl stearate, propyl oleate, glyceride monostearate, glyceride distearate, pentaerythritol tetrabehenate, and the like; ester waxes obtained from higher fatty acids and multivalent alcohol multimers, such as diethyleneglycol monostearate, dipropyleneglycol distearate, diglyceryl distearate, triglyceryl tetrastearate, and the like; sorbitan higher fatty acid ester waxes, such as sorbitan monostearate and the like; and cholesterol higher fatty acid ester waxes, such as cholesteryl stearate and the like; and the like, as well as mixtures thereof. Examples of suitable functionalized waxes include amines, amides, for example AQUA SUPERSLIP 6550™, SUPERSLIP 6530™ available from Micro Powder Inc., fluorinated waxes, for example POLYFLUO 190™ POLYFLUO 200™, POLYSILK 19™, POLYSILK 14™ available from Micro Powder Inc., mixed fluorinated amide waxes, for example MICROSPERSION 19™ available from Micro Powder Inc., imides, esters, quaternary amines, carboxylic acids or acrylic polymer emulsions, for example JONCRYL 74™ 89™, 130™, 537™, and 538™, all available from SC Johnson Wax, chlorinated polypropylenes and polyethylenes available from Allied Chemical and Petrolite Corporation and SC Johnson wax, and the like, as well as mixtures thereof. Mixtures and combinations of the foregoing waxes can also be used. Waxes can be included as, for example, fuser roll release agents. When included, the wax can be present in any desired or effective amount, in one embodiment at least about 1% by weight, and in another embodiment at least about 5% by weight, and in one embodiment no more than about 25% by weight, and in another embodiment no more than about 20% by weight.

In specific embodiments, the wax has a melting point of in one embodiment no more than about 100° C., in another embodiment no more than about 90° C., and in yet another embodiment no more than about 85° C.

Colorants

Examples of suitable colorants include pigments, dyes, mixtures thereof, and the like. Specific examples include carbon black; magnetite; HELIOGEN BLUE L6900, D6840, D7080, D7020, PYLAM OIL BLUE, PYLAM OIL YELLOW, and PIGMENT BLUE 1, available from Paul Uhlich and Company, Inc.; PIGMENT VIOLET 1, PIGMENT RED 48, LEMON CHROME YELLOW DCC 1026, E.D. TOLUIDINE RED, and BON RED C, available from Dominion Color Corporation, Ltd., Toronto, Ontario; NOVAPERM YELLOW FGL and HOSTAPERM PINK E, available from Hoechst; CINQUASIA MAGENTA, available from E.I. DuPont de Nemours and Company; 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180, Permanent Yellow FGL; Neopen Yellow 075, Neopen Yellow 159, Neopen Orange 252, Neopen Red 336, Neopen Red 335, Neopen Red 366, Neopen Blue 808, Neopen Black X53, Neopen Black X55; Pigment Blue 15:3 having a Color Index Constitution Number of 74160, Magenta Pigment Red 81:3 having a Color Index Constitution Number of 45160:3, Yellow 17 having a Color Index Constitution Number of 21105; Pigment Red 122 (2,9-dimethylquinacridone), Pigment Red 185, Pigment Red 192, Pigment Red 202, Pigment Red 206, Pigment Red 235, Pigment Red 269, combinations thereof, and the like.

In one specific embodiment, the colorant comprises (a) a carbon black pigment, in specific embodiments present in an amount of in one embodiment at least about 3% by weight of the toner, and in one embodiment no more than about 6% by weight of the toner, and (b) a copper phthalocyanine pigment, such as Pigment Blue 15:3, in specific embodiments present in an amount of in one embodiment at least about 0.5% by weight of the toner, and in one embodiment no more than about 1.5% by weight of the toner.

The colorant is present in the toner in any desired or effective total amount, in one embodiment at least about 1% by weight of the toner, and in another embodiment at least about 5% by weight of the toner, and in one embodiment no more than about 15% by weight of the toner, and in another embodiment no more than about 10% by weight of the toner.

Toner Preparation

The pH of the resulting mixture can be adjusted by an acid, such as acetic acid, nitric acid, or the like. In specific embodiments, the pH of the mixture can be adjusted to from about 2 to about 4.5. Additionally, if desired, the mixture can be homogenized. If the mixture is homogenized, homogenization can be performed by mixing at from about 600 to about 4,000 revolutions per minute. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the glass transition temperature (Tg) of the resin.

The aggregating agent can be added to the mixture used to form a toner in any desired or effective amount, in one embodiment at least about 0.1% by weight, in another embodiment at least about 0.2% by weight, and in yet another embodiment at least about 0.5% by weight, and in one embodiment no more than about 8% by weight, and in another embodiment no more than about 5% weight of the resin in the mixture.

To control aggregation and coalescence of the particles, the aggregating agent can, if desired, be metered into the mixture over time. For example, the agent can be metered into the mixture over a period of in one embodiment at least about 5 minutes, and in another embodiment at least about 30 minutes, and in one embodiment no more than about 240 minutes, and in another embodiment no more than about 200 minutes. The addition of the agent can also be performed while the mixture is maintained under stirred conditions, in one embodiment at least about 50 rpm, and in another embodiment at least about 100 rpm, and in one embodiment no more than about 1,000 rpm, and in another embodiment no more than about 500 rpm, and, in some specific embodiments, at a temperature that is below the glass transition temperature of the resin as discussed above, in one specific embodiment at least about 30° C., in another specific embodiment at least about 35° C., and in one specific embodiment no more than about 90° C., and in another specific embodiment no more than about 70° C.

The particles can be permitted to aggregate until a predetermined desired particle size is obtained. A predetermined desired size refers to the desired particle size to be obtained as determined prior to formation, with the particle size being monitored during the growth process until this particle size is reached. Samples can be taken during the growth process and analyzed, for example with COULTER COUNTER, for average particle size. Aggregation can thus proceed by maintaining the elevated temperature, or by slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, the growth process is halted. In embodiments, the predetermined desired particle size is within the toner particle size ranges mentioned above.

The growth and shaping of the particles following addition of the aggregation agent can be performed under any suitable conditions. For example, the growth and shaping can be conducted under conditions in which aggregation occurs separate from coalescence. For separate aggregation and coalescence stages, the aggregation process can be conducted under shearing conditions at an elevated temperature, for example of from about 40° C. to about 90° C., in embodiments from about 45° C. to about 80° C., which may be below the glass transition temperature of the resin as discussed above.

Shell Formation

A shell can then be applied to the formed aggregated toner particles. Any resin described above as suitable for the core resin can be used as the shell resin. The shell resin can be applied to the aggregated particles by any desired or effective method. For example, the shell resin can be in an emulsion, including a surfactant. The aggregated particles described above can be combined with said shell resin emulsion so that the shell resin forms a shell over the formed aggregates.

In one specific embodiment, the shell comprises the same resin or resins that are found in the core.

In one specific embodiment, the toner particles have a shell and the cores of the particles comprise a resin having a glass transition temperature (Tg) lower than the Tg of the shells. In specific embodiments, the core has a Tg of in one embodiment at least about 40° C., in another embodiment at least about 45° C., and in yet another embodiment at least about 48° C., and in one embodiment no more than 59° C., in another embodiment no more than about 55° C., and in yet another embodiment no more than about 53° C. In specific embodiments, the shell has a Tg of in one embodiment at least about 55° C., in another embodiment at least about 58° C., and in yet another embodiment at least about 59° C., and in one embodiment no more than 65° C., in another embodiment no more than about 63° C., and in yet another embodiment no more than about 61° C.

Once the desired final size of the toner particles is achieved, the pH of the mixture can be adjusted with a base to a value in one embodiment of from about 6 to about 10, and in another embodiment of from about 6.2 to about 7. The adjustment of the pH can be used to freeze, that is to stop, toner growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts from about 2 to about 25% by weight of the mixture, and in more specific embodiments from about 4 to about 10% by weight of the mixture.

Coalescence

Following aggregation to the desired particle size, with the formation of the shell as described above, the particles can then be coalesced to the desired final shape, the coalescence being achieved by, for example, heating the mixture to any desired or effective temperature, in one embodiment at least about 55° C., and in another embodiment at least about 65° C., and in one embodiment no more than about 100° C., and in another embodiment no more than about 75° C., and in one specific embodiment about 70° C. Higher or lower temperatures may be used, it being understood that the temperature is a function of the resins used for the binder.

Coalescence can proceed and be performed over any desired or effective period of time, in one embodiment at least about 0.1 hour, and in another embodiment at least 0.5 hour, and in one embodiment no more than about 9 hours, and in another embodiment no more than about 4 hours.

After coalescence, the mixture can be cooled to room temperature, typically from about 20° C. to about 25° C. The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze-drying.

Optional Additives

The toner particles can also contain other optional additives as desired.

There can also be blended with the toner particles external additive particles, including flow aid additives, which can be present on the surfaces of the toner particles. Examples of these additives include metal oxides, such as titanium oxide, and the like, as well as mixtures thereof; metal salts and metal salts of fatty acids including zinc stearate, aluminum oxides, cerium oxides, and the like, as well as mixtures thereof. Each of these external additives can be present in any desired or effective amount, in one embodiment at least about 0.1% by weight of the toner, and in another embodiment at least about 0.25% by weight of the toner, and in one embodiment no more than about 5% by weight of the toner, and in another embodiment no more than about 3% by weight of the toner. Suitable additives include those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

Silica

The toners disclosed herein contain specific silica external additives. These additives comprise mixtures of silicas having different average particle diameters and surface treatments. Silica average particle diameters are measured by scanning electron microscopy (SEM).

The toner contains first silica particles, such as fumed silica particles, surface treated with octyldimethylsiloxane, of the formula

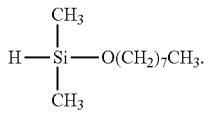

These octyldimethylsiloxane treated silica particles have an average particle diameter of in one embodiment at least about 6 nm, in another embodiment at least about 8 nm, and in yet another embodiment at least about 10 nm, and in one embodiment no more than about 20 nm, in another embodiment no more than about 1 nm, and in yet another embodiment no more than about 15 nm.

The octyldimethylsiloxane treated silica particles are present in the toner in an amount of in one embodiment at least about 0.1% by weight (of the toner), in another embodiment at least about 0.2% by weight, and in yet another embodiment at least about 0.3% by weight, and in one embodiment no more than about 1% by weight, in another embodiment no more than about 0.9% by weight, and in yet another embodiment no more than about 0.8% by weight.

The toners disclosed herein also contain second silica particles comprising colloidal silica particles of the formula The colloidal silica particles are surface treated with hexamethyldisiloxane, of the formula

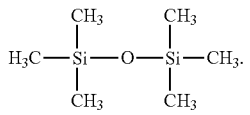

These hexamethyldisiloxane treated colloidal silica particles have an average particle diameter of in one embodiment at least about 80 nm, in another embodiment at least about 85 nm, and in yet another embodiment at least about 90 nm, and in one embodiment no more than about 200 nm, in another embodiment no more than about 180 nm, and in yet another embodiment no more than about 150 nm.

The hexamethyldisiloxane treated colloidal silica particles are present in the toner in an amount of in one embodiment at least about 1% by weight, in another embodiment at least about 1.05 by weight, and in yet another embodiment at least about 1.10% by weight, and in one embodiment no more than about 2% by weight, in another embodiment no more than about 1.75% by weight, and in yet another embodiment no more than about 1.45% by weight.

The toners disclosed herein also contain third silica particles, such as fumed silica particles, surface treated with polydimethylsiloxane, of the formula

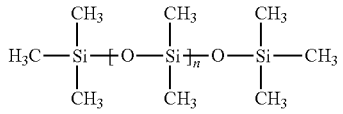

wherein n is an integer representing the number of repeat monomer units, and is in one embodiment at least about 1, and in one embodiment no more than about 45. These polydimethylsiloxane treated silica particles have an average particle diameter of in one embodiment at least about 25 nm, in another embodiment at least about 27 nm, and in yet another embodiment at least about 30 nm, and in one embodiment no more than about 65 nm, in another embodiment no more than about 60 nm, and in yet another embodiment no more than about 55 nm. Examples of suitable polydimethylsiloxane treated silica particles include those available as RY50 from Evonik, TG5180 from Cabot Corporation, or the like.

The polydimethylsiloxane treated silica particles are present in the toner in an amount of in one embodiment at least about 0.5% by weight, in another embodiment at least about 0.6% by weight, and in yet another embodiment at least about 0.7% by weight, and in one embodiment no more than about 1.5% by weight, in another embodiment no more than about 1.2% by weight, and in yet another embodiment no more than about 0.9% by weight.

The toners disclosed herein also contain fourth silica particles, such as fumed silica particles, surface treated with hexamethyldisiloxane, of the formula

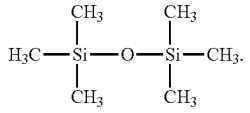

These hexamethyldisiloxane treated silica particles have an average particle diameter of in one embodiment at least about 25 nm, in another embodiment at least about 27 nm, and in yet another embodiment at least about 30 nm, and in one embodiment no more than about 65 nm, in another embodiment no more than about 60 nm, and in yet another embodiment no more than about 55 nm.

The hexamethyldisiloxane treated fumed silica particles are present in the toner in an amount of in one embodiment at least about 1% by weight, in another embodiment at least about 1.25% by weight, and in yet another embodiment at least about 1.5% by weight, and in one embodiment no more than about 2.5% by weight, in another embodiment no more than about 2% by weight, and in yet another embodiment no more than about 1.8% by weight.

Toner Characteristics

The toner particles have a circularity of in one embodiment at least about 0.920, in another embodiment at least about 0.940, in yet another embodiment at least about 0.962, and in still another embodiment at least about 0.965, and in one embodiment no more than about 0.999, in another embodiment no more than about 0.990, and in yet another embodiment no more than about 0.980. A circularity of 1.000 indicates a completely circular sphere. Circularity can be measured with, for example, a SYSMEX FPIA 2100 analyzer.

Emulsion aggregation processes provide greater control over the distribution of toner particle sizes and can limit the amount of both fine and coarse toner particles in the toner. The toner particles can have a relatively narrow particle size distribution with a lower number ratio geometric standard deviation (GSDn) of in one embodiment at least about 1.15, in another embodiment at least about 1.18, and in yet another embodiment at least about 1.20, and in one embodiment no more than about 1.40, in another embodiment no more than about 1.35, in yet another embodiment no more than about 1.30, and in still another embodiment no more than about 1.25.

The toner particles can have a volume average diameter (also referred to as "volume average particle diameter" or "$D_{50v}$") of in one embodiment at least about 3 μm, in another embodiment at least about 4 μm, and in yet another embodiment at least about 5 μm, and in one embodiment no more than about 25 μin another embodiment no more than about 15 μm, and in yet another embodiment no more than about 12 μm. $D_{50v}$, GSDv, and GSDn can be determined using a measuring instrument such as a BECKMAN COULTER Multisizer 3, operated in accordance with the manufacturer's instructions. Representative sampling can occur as follows: a small amount of toner sample, about 1 g, can be obtained and filtered through a 25 μm, then put in isotonic solution to obtain a concentration of about 10%, with the sample then run in a BECKMAN COULTER Multisizer 3.

The toner particles can have a shape factor of in one embodiment at least about 105, and in another embodiment at least about 110, and in one embodiment no more than about 170, and in another embodiment no more than about 160, SF1*a. Scanning electron microscopy (SEM) can be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The characteristics of the toner particles may be determined by any suitable technique and apparatus and are not limited to the instruments and techniques indicated hereinabove.

In embodiments where the toner resin is crosslinkable, such crosslinking can be performed in any desired or effective manner. For example, the toner resin can be crosslinked during fusing of the toner to the substrate when the toner resin is crosslinkable at the fusing temperature. Crosslinking can also be effected by heating the fused image to a temperature at which the toner resin will be crosslinked, for example in a post-fusing operation. In specific embodiments, crosslinking can be effected at temperatures of in one embodiment about 160° C. or less, in another embodiment from about 70° C. to about 160° C., and in yet another embodiment from about 80° C. to about 140° C.

In one specific embodiment, the toner particles are applied to the substrate via a single component development process. In single component development, the charge on the toner is what controls the development process. Donor roll materials are selected to generate a charge of the right polarity on the toner when the toner is brought in contact with the roll. The toner layer formed on the donor roll by electrostatic forces is passed through a charging zone, specifically in this application a charging roller, before entering the development zone. Light pressure in the development nip produces a toner layer of the desired thickness on the roll as it enters the development zone. This charging typically will be for only a few seconds, minimizing the charge on the toner. An additional bias is then applied to the toner, allowing for further development and movement of the controlled portion of toner to the photoreceptor. The image is then transferred from the photoreceptor to an image receiving substrate, which transfer may be direct or indirect via an intermediate transfer member, and then the image is fused to the image receiving substrate, for example by application of heat and/or pressure, such as with a heated fuser roll.

Single component development processes are known. The toners as disclosed herein can be used in known single component development methods, such as, for example, those disclosed in U.S. Pat. No. 5,738,966, the disclosure of which is totally incorporated herein by reference.

Any suitable substrate or recording sheet can be employed, including plain papers such as XEROX® 4024 papers, XEROX® Image Series papers, Courtland 4024 DP paper, ruled notebook paper, bond paper, silica coated papers such as Sharp Company silica coated paper, JuJo paper, HAMMERMILL LASERPRINT® paper, and the like, glossy coated papers such as XEROX® Digital Color Gloss, Sappi Warren Papers LUSTROGLOSS®, and the like, transparency materials, fabrics, textile products, plastics, polymeric films, inorganic substrates such as metals and wood, and the like.

Specific embodiments will now be described in detail. These examples are intended to be illustrative, and the claims are not limited to the materials, conditions, or process parameters set forth in these embodiments. All parts and percentages are by weight unless otherwise indicated.

Toner Particle Preparation

The toner particles used in the Examples and Comparative Examples were prepared as follows. A 2 L reactor was charged with 60-68% styrene/butylacrylate latex polymer containing 76.5 parts by weight styrene, 23.5 parts by weight butylacrylate, and 3 parts by weight β-carboxyethylacrylate and having a weight average molecular weight of 35,000, 10-14% paraffin wax having a molecular weight of 527 and a melting temperature of 84° C., 3-5% carbon black, and 0.5-1.5% Pigment Blue 15:3. 0.14-0.18% Polyaluminum chloride was then added to the system and the mix homogenized for 20-40 min at 4000 rpm with a IKA T-50 homogenizer. Once homogenized the reactor contents were heated to near the glass transition temperature of the polymer (from 50-58° C.) for 90-160 min until the particle reached a pre-shell size of 5.8-6.4 μm. Once the aggregate was at the appropriate size a second styrene/butylacrylate latex polymer containing 82 parts by weight styrene, 18 parts by weight butylacrylate, and 3 parts by weight β-carboxyethylacrylate and having a weight average molecular weight of 35,000 (Tg 56-62° C.) was added to create a shell of 27-33% by weight of the toner particle. After the shell was added the reactor was held at temperature for 20-60 min, after which a base was added to freeze the particle size at 7.0-7.8 μm. Once the base was added and the pH adjusted to 4.2-5.0, the particle batch temperature was raised to 90-98° C. The batch then coalesced for 30-300 min until a sphericity (roundness) of the particle was achieved at 0.963-0.973. The batch was then cooled, the pH was adjusted to 7.0-8.0 with NaOH, and it was then washed with 3-5 water washes and dried by freeze drying.

Example I

A first toner (Toner Ia) was prepared as follows. Dried particles prepared as described above and having a dry particle size of 6.8 μm and a dry sphericity of 0.963 were weighed out to 75 g and initially mixed with 0.35% (by weight of the toner) 8-15 nm octyldimethylsiloxane coated fumed silica, 0.73% 30-50 nm polydimethylsiloxane coated fumed silica, 1.10% 90-150 nm hexamethyldisiloxane coated colloidal sol gel silica, and 1.55% 30-50 nm hexamethyldisiloxane coated fumed silica. After initial mixing, the toner particles and silica particles were blended in a FUJI MILL laboratory blender for 5 min at 16,000 rpm. The toner was then placed in a cartridge and tested in a monochrome single component development machine.

A second toner (Toner Ib) was prepared as follows. Dried particles prepared as described above and having a dry particle size of 7.2 μm and a dry sphericity of 0.960 were weighed out to 75 g and initially mixed with 0.83% (by weight of the toner) 8-15 nm octyldimethylsiloxane coated fumed silica, 0.82% 30-50 nm polydimethylsiloxane coated fumed silica, 1.35% 90-150 nm hexamethyldisiloxane coated colloidal sol gel silica, and 1.60% 30-50 nm hexamethyldisiloxane coated fumed silica. After initial mixing, the toner particles and silica particles were blended in a FUJI MILL laboratory blender for 5 min at 160,000 rpm. The toner was then placed in a cartridge and tested in a monochrome single component development machine.

Comparative Example A

Toner particles were prepared as described in the first paragraph of Example I. Final dry particle size was 6.8 μm and dry particle sphericity was 0.978. Dried particles were mixed by the process described in Example I with 3.0% (by weight of the toner) 30-50 nm polydimethylsiloxane coated fumed silica, 0.2% 90-150 nm hexamethyldisiloxane coated colloidal sol gel silica, and 0.55% 30-50 nm hexamethyldisiloxane coated fumed silica.

Comparative Example B

Toner particles were prepared as described in the first paragraph of Example I. Particle size was frozen at 7.48 μm and sphericity was achieved at 0.972. Dried particles were mixed by the process described in Example I with 0.1% (by weight of the toner) 8-15 nm octyldimethylsiloxane coated fumed silica, 2.5% 30-50 nm polydimethylsiloxane coated fumed silica, 0.2% 90-150 nm hexamethyldisiloxane coated colloidal sol gel silica, and 0.55% 30-50 nm hexamethyldisiloxane coated fumed silica.

Organic Photoreceptor Contamination Testing

Organic Photoreceptor (OPC) contamination was measured by placing a 20 cm long by 2 cm wide piece of single-sided transparent adhesive tape on a piece of XEROX® 4200 paper as background control. Thereafter, a 20 cm by 5 cm solid pattern was printed on paper, the machine was stopped, and another 20 cm long by 2 cm wide piece of single-sided transparent adhesive tape was placed on the photoreceptor to remove any residual toner. This tape was then also placed on the XEROX® 4200 paper. The delta Y was measured using an XRITE® densitometer of the tape from the photoreceptor and subtracting off the background control. (This process was done at 0 pages, 1,000 pages, and 2,000 pages). The delta Y was a measure of the % reflectance, quantifying photoreceptor contamination. The higher the delta Y, the worse the drum contamination. Toners Ia and Ib showed superior performance with respect to Comparative Toners A and B.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A single component developer comprising an emulsion aggregation toner which comprises:

(a) a resin;

(b) a wax;

(c) a colorant;

(d) an encapsulating shell; and (e) a silica external additive, said silica external additive comprising:

(i) first silica particles, said first silica particles comprising fumed silica particles surface treated with octyldimethylsiloxane and having an average particle diameter of from about 6 to about 20 nm, present in an amount of from about 0.1% to about 1% by weight of the toner;

(ii) second silica particles, said second silica particles comprising colloidal silica particles surface treated with hexamethyldisiloxane and having an average particle diameter of from about 80 to about 200 nm, present in an amount of from about 1% to about 2% by weight of the toner;

(iii) third silica particles, said third silica particles comprising fumed silica particles surface treated with polydimethylsiloxane and having an average particle diameter of from about 25 to about 65 nm, present in an amount of from about 0.5% to about 1.5% by weight of the toner; and (iv) fourth silica, particles, said fourth silica particles comprising fumed silica particles surface treated with hexamethyldisiloxane and having an average particle diameter of from about 25 to about 65 nm, present in an amount of from about 1% to about 2.5% by weight of the toner;

said developer being substantially free of carrier particles.

2. A developer according to claim 1 wherein the resin comprises a styrene/butylacrylate copolymer.

3. A developer according to claim 2 wherein the styrene/butylacrylate copolymer is a styrene/n-butylacrylate/β-carboxyethylacrylate copolymer.

4. A developer according to claim 3 wherein the styrene/n-butylacrylate/β-carboxyethylacrylate copolymer has a ratio of monomers of from about 69 to about 90 parts by weight styrene, from about 9 to about 30 parts by weight n-butylacrylate, and from about 1 to about 10 parts by weight β-carboxyethylacrylate, wherein the Mw value is from about 30,000 to about 40,000, and wherein the Mn value is from about 8,000 to about 15,000.

5. A developer according to claim 2 wherein the resin has a Mw value of from about 30,000 to about 40,000 and a Mn value of from about 8,000 to about 15,000.

6. A developer according to claim 1 wherein the wax is a paraffin wax.

7. A developer according to claim 1 wherein the wax has a melting point of no more than about 100° C.

8. A developer according to claim 1 wherein the wax is present in the toner in an amount of from about 1% to about 25% by weight of the toner.

9. A developer according to claim 1, wherein the colorant is a pigment.

10. A developer according to claim 9 wherein the pigment comprises carbon black in an amount of from about 3% to about 6% by weight of the toner and copper phthalocyanine in an amount of from about 0.5% to about 1.5% of the toner.

11. A developer according to claim 1 wherein the toner comprises toner particles having a circularity of from about 0.920 to about 0.999.

12. A developer according to claim 1 wherein the toner comprises toner particles having a volume average particle diameter of from about 3 to about 25 μm.

13. A developer according to claim 1 wherein the first silica particles have an average particle diameter of from about 8 to about 18 nm and are present in the toner in an amount of from about 0.2% to about 0.9% by weight.

14. A developer according to claim 1 wherein the second silica particles have an average particle diameter of from about 85 to about 180 nm and are present in the toner in an amount of from about 1.05% to about 1.75% by weight.

15. A developer according to claim 1 wherein the third silica particles have an average particle diameter of from about 27 to about 60 nm and are present in the toner in an amount of from about 0.6% to about 1.2% by weight.

16. A developer according to claim 1 wherein the fourth silica particles have an average particle diameter of from about 27 to about 60 nm and are present in the toner in an amount of from about 1.25% to about 2% by weight.

17. A single component developer comprising an emulsion aggregation toner which comprises:

(a) a styrene/butylacrylate copolymer resin;

(b) a wax having a melting point of no more than about 100° C.;

(e) a colorant;

(d) an encapsulating shell; and (e) a silica external additive, said silica external additive comprising:

(i) first silica particles, said first silica particles comprising fumed silica particles surface treated with octyldimethylsiloxane and having an average particle diameter of from about 8 to about 18 nm, present in an amount of from about 0.2% to about 0.9% by weight of the toner;

(ii) second silica particles, said second silica particles comprising colloidal silica particles surface treated with hexamethyldisiloxane and having an average particle diameter of from about 85 to about 180 nm, present in an amount of from about 1.05% to about 1.75% by weight of the toner;

(iii) third silica particles, said third silica particles comprising fumed silica particles surface treated with polydimethylsiloxane and having an average particle diameter of from about 27 to about 60 nm, present in an amount of from about 0.6% to about 1.2% by weight of the toner; and (iv) fourth silica, particles, said fourth silica particles comprising fumed silica particles surface treated with hexamethyldisiloxane and having an average particle diameter of from about 27 to about 60 nm, present in an amount of from about 1.25% to about 2% by weight of the toner;

said developer being substantially free of carrier particles.

18. A developer according to claim 17 wherein the wax is a paraffin wax.

19. A developer according to claim 17 wherein the colorant is a pigment.

20. A single component developer comprising an emulsion aggregation toner which comprises:

(a) a styrene/butylacrylate copolymer resin having a Mw value of from about 30,000 to about 40,000 and a Mn value of from about 8,000 to about 15,000;

(b) a paraffin wax having a melting point of no more than about 100° C. and present in the toner in amount of from about 1% to about 25% by weight;

(c) a pigment colorant;

(d) an encapsulating shell; and (e) a silica external additive, said silica external additive comprising:

(i) first silica particles, said first silica particles comprising fumed silica particles surface treated with octyldimethylsiloxane and having an average particle diameter of from about 10 to about 15 nm, present in an amount of from about 0.3% to about 0.8% by weight of the toner;

(ii) second silica particles, said second silica particles comprising colloidal silica particles surface treated with hexamethyldisiloxane and having an average particle diameter of from about 90 to about 150 nm, present in an amount of from about 1.10% to about 1.45% by weight of the toner;

(iii) third silica particles, said third silica particles comprising fumed silica particles surface treated with polydimethylsiloxane and having an average particle diameter of from about 30 to about 55 nm, present in an amount of from about 0.7% to about 0.9% by weight of the toner; and (iv) fourth silica particles, said fourth silica particles comprising fumed silica particles surface treated with hexamethyldisiloxane and having an average particle diameter of from about 30 to about 55 nm, present in an amount of from about 1.5% to about 1.8% by weight of the toner;

said developer being substantially free of carrier particles.

* * * * *